US009772581B2

(12) United States Patent
Ogino et al.

(10) Patent No.: US 9,772,581 B2
(45) Date of Patent: Sep. 26, 2017

(54) DEVELOPER CONTAINER CONFIGURED TO REDUCE DEAD SPACE IN THE PATH OF THE DEVELOPER

(71) Applicant: CANON KABUSHIKI KAISHA, Tokyo (JP)

(72) Inventors: Hiroki Ogino, Mishima (JP); Tomonori Matsunaga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/077,266

(22) Filed: Mar. 22, 2016

(65) Prior Publication Data

US 2016/0282757 A1 Sep. 29, 2016

(30) Foreign Application Priority Data

Mar. 27, 2015 (JP) ..... 2015-065550

(51) Int. Cl.
*G03G 15/08* (2006.01)
*G03G 21/16* (2006.01)

(52) U.S. Cl.
CPC ..... *G03G 15/0865* (2013.01); *G03G 15/0877* (2013.01); *G03G 21/1676* (2013.01)

(58) Field of Classification Search
CPC ..... G03G 15/0865; G03G 15/0877; G03G 21/1676
USPC ..... 399/261
See application file for complete search history.

(56) References Cited

U.S. PATENT DOCUMENTS

| | | | | |
|---|---|---|---|---|
| 7,899,369 | B2 | 3/2011 | Kurogawa | |
| 8,064,806 | B2 | 11/2011 | Nishiwaki et al. | |
| 8,081,909 | B2 | 12/2011 | Nishiwaki et al. | |
| 8,874,010 | B2 | 10/2014 | Wada | |
| 2007/0286645 | A1 | 12/2007 | Hayashi | |
| 2009/0129822 | A1* | 5/2009 | Toh | G03G 15/0877 399/258 |
| 2012/0163876 | A1* | 6/2012 | Wada | G03G 15/0822 399/258 |
| 2014/0219688 | A1 | 8/2014 | Murata et al. | |
| 2016/0097993 | A1 | 4/2016 | Shinohara et al. | |

FOREIGN PATENT DOCUMENTS

| | | | |
|---|---|---|---|
| JP | 59-227618 | A | 12/1984 |
| JP | 04178671 | A * | 6/1992 |
| JP | 2002-196585 | A | 7/2002 |

* cited by examiner

*Primary Examiner* — Quana M Grainger
(74) *Attorney, Agent, or Firm* — Canon USA, Inc. I.P. Division

(57) ABSTRACT

A developer container, which is configured to contain developer therein, includes a developer conveyance plate configured to allow the developer to be placed thereon and convey the developer, an opening member including an opening for discharging the developer, and a coupling member coupling the opening member and the developer conveyance plate with each other. The developer conveyance plate includes a vibration target unit configured to receive a vibration. The coupling member extends/compresses, or swings when the developer conveyance plate conveys the developer toward an opening side where the opening is located.

14 Claims, 6 Drawing Sheets

DEVELOPER CONTAINER CONFIGURED TO REDUCE DEAD SPACE IN THE PATH OF THE DEVELOPER

BACKGROUND OF THE INVENTION

Field of the Invention

The present invention relates to a developer container, a developing apparatus, a process cartridge, and an image forming apparatus. Examples of the image forming apparatus include an electrophotographic copying machine that forms an image on a recording medium with use of an electrophotographic image forming method, an electrophotographic printer (such as a laser beam printer and a light-emitting diode (LED) printer, for example), and a facsimile apparatus.

Description of the Related Art

Conventionally, there has been disclosed a configuration including, inside a developer container detachably mounted within an image forming apparatus, a stirring conveyance member configured to convey a contained developer toward a developing roller while stirring the developer, such as a configuration discussed in Japanese Patent Application Laid-Open No. 2002-196585. The configuration discussed in this patent literature uses a plurality of stirring conveyance members.

Further, there has been disclosed a powdery/granular material conveyance apparatus including a swingably supported bearing member for a powdery/granular material and a vibration generator for providing a vibration to this bearing member, and configured to convey the powdery/granular material borne on the bearing member by vibrating this bearing member, such as an apparatus discussed in Japanese Patent Application Laid-Open No. 59-227618.

However, according to the configuration discussed in Japanese Patent Application Laid-Open No. 2002-196585, the stirring conveyance member conveys only the developer located within a radius of a rotation. Therefore, a bottom surface of a storage container should be formed so as to have an arc-like shape in cross-section. For example, a protruding portion is formed on a floor surface of the storage container that the stirring conveyance member cannot reach, so that the developer is prevented from being accumulated on a region where this protruding portion is formed. This protruding portion becomes a dead space, thereby leading to a reduction in a volume that accommodates the developer.

Further, according to the configuration discussed in Japanese Patent Application Laid-Open No. 59-227618, an enough space should be set aside to allow the entire bearing member to swing, and this space becomes the dead space.

SUMMARY OF THE INVENTION

The present invention has been contrived to solve the above-described problem, and is directed to a developer container capable of reducing a dead space in a path along which the developer is conveyed.

According to an aspect of the present invention, a developer container, which is configured to contain developer therein, includes a conveyance member configured to allow the developer to be placed thereon and convey the developer, an opening member including an opening for discharging the developer, and a coupling member coupling the opening member and the developer conveyance plate with each other. The developer conveyance plate includes a vibration target unit configured to receive a vibration. The coupling member extends/compresses, or swings when the developer conveyance plate conveys the developer toward an opening side where the opening is located.

Further features of the present invention will become apparent from the following description of exemplary embodiments with reference to the attached drawings.

DESCRIPTION OF THE EMBODIMENTS

One exemplary embodiment of an image forming apparatus on which a process cartridge including a developing apparatus equipped with a developer container according to each of exemplary embodiments of the present invention is detachably mounted will be specifically described with reference to the drawings. However, the present invention does not necessarily have to be limited to dimensions, materials, shapes, a relative layout, and the like of component parts that will be described in each of the following exemplary embodiments. Further, in the following description, a longitudinal direction of the process cartridge is an axial direction of an image bearing member. Further, a left and a right respectively mean a left and a right, in a direction in which the recording medium is conveyed, when a recording medium is viewed from above. Further, an upper surface and a lower surface of the process cartridge mean a surface located on an upper side and a surface located on a lower side with the process cartridge mounted on a main body of the image forming apparatus, respectively.

Figure 1:
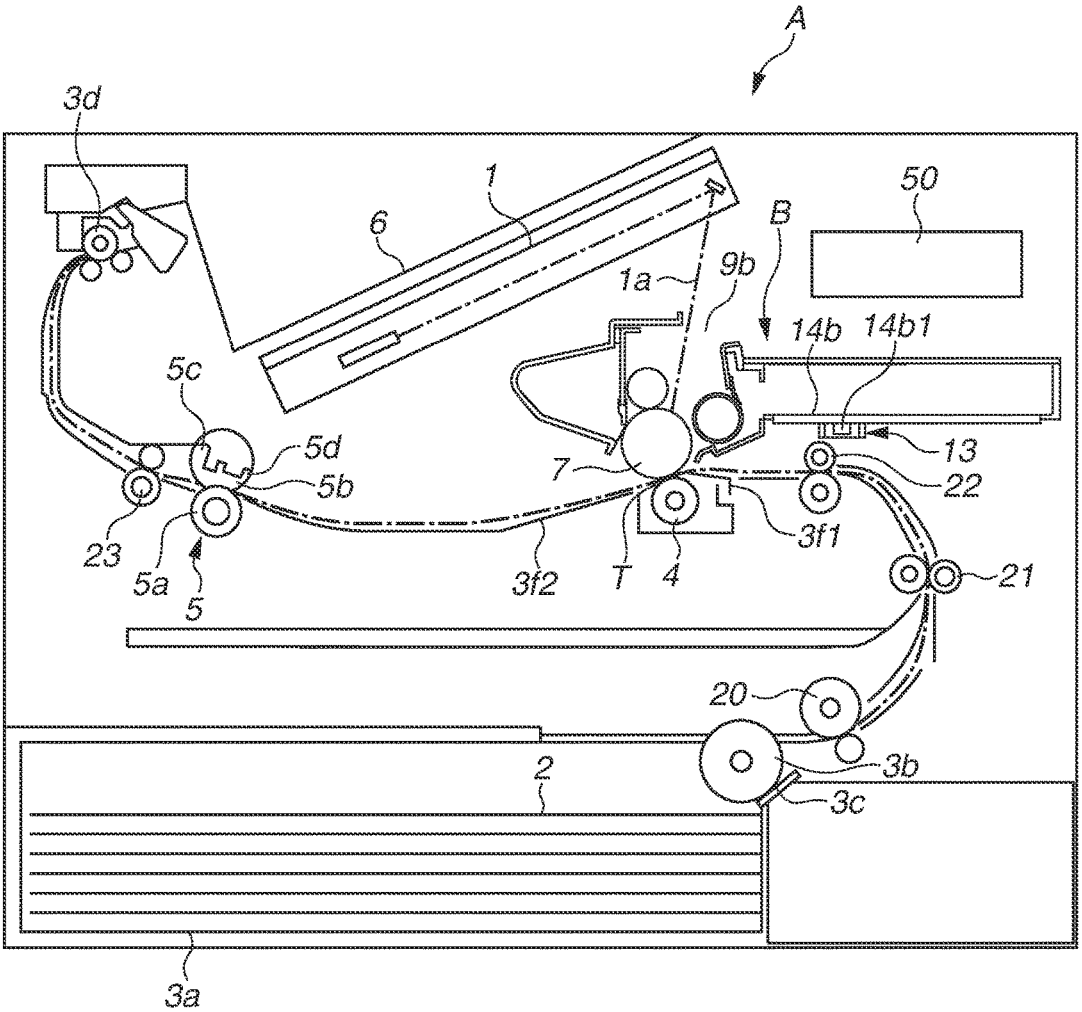
FIG. 1 is an illustrative cross-sectional view illustrating a configuration of an image forming apparatus on which a process cartridge including a developing apparatus equipped with a developer container according to an exemplary embodiment of the present invention is detachably mounted.
Figure 2:
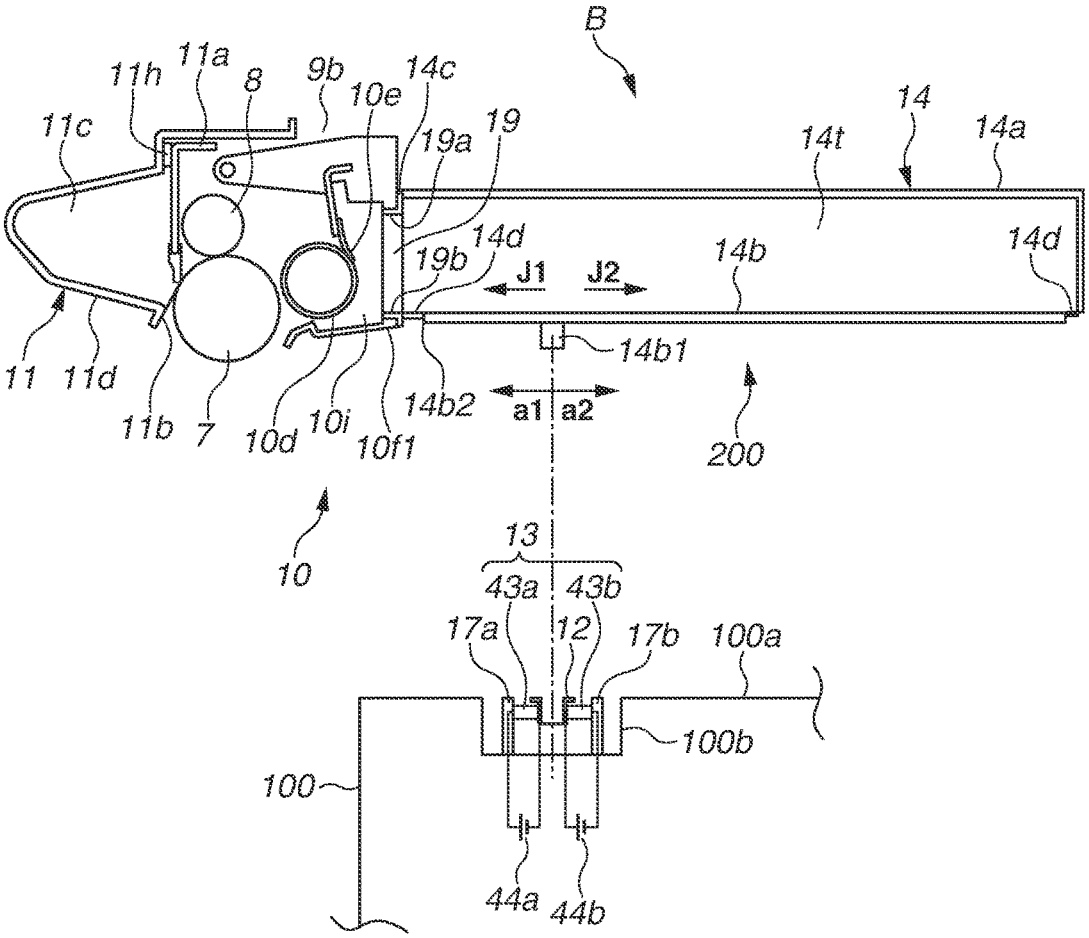
FIG. 2 is an illustrative cross-sectional view illustrating a configuration of a first exemplary embodiment of the process cartridge including the developing apparatus equipped with the developer container according to the exemplary embodiment of the present invention and the image forming apparatus on which this process cartridge is to be mounted.

FIGS. 1 to 3 relate to a first exemplary embodiment of the image forming apparatus on which the process cartridge including the developing apparatus equipped with the developer container according to one of the exemplary embodiments of the present invention is detachably mounted. First, a configuration of this first exemplary embodiment will be described with reference to FIGS. 1 to 3.

<Image Forming Apparatus>

An overall configuration of an electrophotographic image forming apparatus 100 will be described now with reference to FIG. 1. FIG. 1 is an illustrative cross-sectional view illustrating a configuration of the image forming apparatus 100 on which a process cartridge B (process cartridge) according to the first exemplary embodiment is mounted. The image forming apparatus 100 according to the present exemplary embodiment is an example in which the present invention is applied to a laser beam printer.

As illustrated in FIG. 1, the image forming apparatus 100 includes the process cartridge B detachably mounted on a main body of this image forming apparatus 100. A photosensitive drum 7, which serves as an image bearing member, is disposed in the process cartridge B.

Further, the image forming apparatus 100 emits, from a laser scanner which serves as an image exposure unit, laser light 1*a* based on image information onto a surface of the photosensitive drum 7 evenly charged by a charging roller 8 illustrated in FIG. 2, which serves as a charging unit, to scan and expose this surface with and to the laser light 1*a*. As a result, an electrostatic latent image is formed on the surface of the photosensitive drum 7.

After that, application of a developing bias voltage to the developing roller 10*d* illustrated in FIG. 2, which serves as the developer bearing member, causes toner borne on a surface of this developing roller 10*d*, which is used as developer, to be supplied to the electrostatic latent image formed on the surface of the photosensitive drum 7 to develop the electrostatic latent image, thereby forming a toner image.

On the other hand, recording media 2 are fed from a sheet cassette 3*a* illustrated in FIG. 1 by a pickup roller 3*b* in synchronization with the operation of forming the toner image onto the surface of the photosensitive drum 7. Examples usable as the recording medium 2 include paper, an overhead transparency (OHT) sheet used together with an overhead projector (OHP) and made of a transparent sheet, and a fabric. Then, the recording media 2 are separated and fed one by one by collaboration between the pickup roller 3*b* and a separation member 3*c* disposed in pressure contact with this pickup roller 3*b*.

After being separated and fed one by one by the collaboration between the pickup roller 3*b* and the separation member 3*c*, the recording media 2 are sequentially conveyed by conveyance rollers 20 and 21, and a leading edge of each of the recording media 2 runs into a registration roller 22 that is temporarily static. Then, firmness of a material of this recording medium 2 allows the leading edge of this recording medium 2 to be brought into abutment along a nip portion of the registration rollers 22, which contributes to a correction of a skew.

After that, the recording medium 2 is conveyed while being sandwiched by the registration rollers 22 in such a manner that a position thereof matches the toner image formed on the surface of the photosensitive drum 7. Then, this recording medium 2 is conveyed along a conveyance guide 3*f*1 to a transfer nip portion T, where the photosensitive drum 7 disposed in the process cartridge B and a transfer roller 4 serving as a transfer unit are located opposite from each other.

Then, a transfer bias voltage is applied to the transfer roller 4, by which the toner image formed on the surface of the photosensitive drum 7 is transferred onto the recording medium 2 conveyed to the transfer nip portion T. The recording medium 2 with the toner image transferred thereon is conveyed along a conveyance guide 3*f*2 to a fixing device 5, which serves as a fixing unit.

The fixing device 5 includes a driving roller 5*a*, and a fixing rotational member 5*d* constructed with use of a cylindrical sheet containing a heater 5*b* therein and rotatably supported by a support member 5*c*. Then, the fixing device 5 applies heat and a pressure onto the recording medium 2 passing through a fixing nip portion between the fixing rotational member 5*d* and the driving roller 5*a*, by which the toner image is fixed onto this recording medium 2 by being heated.

The recording medium 2 with the toner image fixed thereon by being heated by the fixing device 5 is conveyed to a discharge roller 3*d* by a conveyance roller 23. The discharge roller 3*d* discharges the recording medium 2 with the toner image fixed thereon to a discharge unit 6. The image forming apparatus 100 forms an image onto the recording medium 2 with use of the developer (the toner) in this manner.

A controller 50 illustrated in FIG. 1, which serves as a control unit, controls driving of various kinds of devices disposed within the main body of the image forming apparatus 100. The controller 50 according to the present exemplary embodiment controls driving of a vibration providing member 13, which will be described in detail below.

<Process Cartridge>

Next, a configuration of the process cartridge B will be described with reference to FIG. 2. FIG. 2 is an illustrative cross-sectional view illustrating the configuration of the process cartridge B. As illustrated in FIG. 2, the process cartridge B according to the present exemplary embodiment includes the photosensitive drum 7 as the image bearing member that bears the toner image (a developer image), and at least one image forming process unit.

The at least one image forming process units includes the charging roller 8, which serves as the charging unit that charges the surface of the photosensitive drum 7, and the developing unit 10, which serves as the developing unit that develops the electrostatic latent image formed on the surface of the photosensitive drum 7. Further, the at least one image forming process units include, for example, a cleaning blade 11*a*, which serves as a cleaning unit that cleans the surface of the photosensitive drum 7 by removing the tonner remaining on the surface of the photosensitive drum 7 after the toner image is transferred therefrom.

A drum unit 11 illustrated in FIG. 2 includes a drum frame 11*d*, which rotatably supports the photosensitive drum 7. Further, the cleaning blade 11*a* is disposed in the drum frame 11*d*. Further, the charging roller 8 is rotatably disposed in the drum frame 11*d*. Further, a removed toner storage unit 11*c* and a gathering sheet 11*b* are provided in the drum frame 11*d*.

The developing unit 10 includes a developing frame 10*f*1, which rotatably supports the developing roller 10*d*. A developing chamber 10*i* is formed in the developing frame 10*f*1.

A developer container 14, which contains the toner to be used as the developer, includes a frame member 14*a*, and a developer conveyance plate 14*b*, which serves as a plate-shaped conveyance member on a surface of which the toner to be used as the developer is placed and conveyed. The frame member 14*a* and the developer conveyance plate 14*b* form an outer shell of the developer container 14. Further, the developer conveyance plate 14*b*, which serves as the conveyance member, includes a vibration target unit 14*b*1, which receives driving (a vibration) for conveying the toner to be used as the developer and then transmits the driving (the vibration) to this developer conveyance plate 14*b*. The vibration target unit 14*b*1 is located below the developer conveyance plate 14*b*.

The developer container 14 further includes an opening member 14*c*, which has an opening 19 for discharging the toner to be used as the developer from this developer container 14. Further, the developer container 14 includes a flexible coupling member 14*d*, which couples the frame member 14*a*, the opening member 14*c*, and the developer conveyance plate 14*b* with one another. The flexible coupling member 14*d* is disposed across an entire circumference of the developer conveyance plate 14*b*. The coupling member 14*d* extends/compresses, or swings when the developer conveyance plate 14*b* serving as the conveyance member conveys the developer toward the opening 19 side (an opening side).

A developer storage unit (a storage unit) 14*t*, where the developer is stored, is formed by the developer conveyance plate 14*b* serving as the conveyance member, the coupling member 14*d*, the opening member 14*c*, and the frame member 14*a*. As understood from FIG. 2, the developer conveyance plate 14*b*, which serves as the conveyance member, forms a bottom of the developer storage unit 14*t*. Therefore, a member for forming the bottom does not need to be prepared additionally. The developer conveyance plate 14*b*, which serves as the conveyance member, is disposed on a lower side (a lower end side) where a lower end 19*b* of the opening 19 is located. The opening 19 includes an upper end 19*a*.

The developer container 14 stores the developer (the toner) in the developer storage unit 14*t*. The developer container 14 is connected to the developing unit 10 by the opening member 14*c* coupled with the developing unit 10, and the developing chamber 10*i* of the developing unit 10 and the developer storage unit 14*t* of the developer container 14 are in communication with each other via the opening 19 of the opening member 14*c*. The process cartridge B according to the present exemplary embodiment includes the drum unit 11, the developing unit 10, and the developer container 14.

<Image Forming Process>

Next, an image forming process by the process cartridge B will be described with reference to FIGS. 1 and 2. Referring to FIG. 2, first, the photosensitive drum 7 having a photosensitive layer is rotated, and a charging bias voltage is applied to the charging roller 8 serving as the charging unit, by which the surface of the photosensitive drum 7 is evenly charged.

After that, the evenly charged surface of the photosensitive drum 7 is scanned with and exposed to the laser light 1*a* based on the image information that is emitted from the laser scanner 1 illustrated in FIG. 1 via an exposure opening 9*b* provided at the drum frame 11*d* of the process cartridge B. As a result, the electrostatic latent image is formed on the surface of this photosensitive drum 7.

After that, the developing bias voltage is applied to the developing roller 10*d* disposed in the developing unit 10 (the developing apparatus), by which the developer (the toner) borne on the surface of this developing roller 10*d* is supplied to the electrostatic latent image formed on the surface of the photosensitive drum 7. As a result, the electrostatic latent image formed on the surface of the photosensitive drum 7 is developed to be visualized into a visible image as the toner image.

The developing unit 10 rotatably supports the developing roller 10*d* as the developer bearing member that bears the developer. In the present exemplary embodiment, as illustrated in FIG. 2, the developer conveyance plate 14*b* serving as the conveyance member, the coupling member 14*d*, the opening 19, and the developing roller 10*d* serving as the developer bearing member are arranged in this order from an upstream side to a downstream side in the developer conveyance direction J1 (from a right side to a left side in FIG. 2).

A toner layer provided with a charge from frictional electrification by a developing blade 10*e* together with the rotation of the developing roller 10*d* is formed on the surface of this developing roller 10*d*. The toner borne on the surface of the developing roller 10*d* is transferred to the electrostatic latent image on the surface of the photosensitive drum 7, by which the toner image is formed onto the surface of the photosensitive drum to visualize the electrostatic latent image into the visible image.

After that, the transfer bias voltage, which has an opposite polarity from a polarity of the toner image on the surface of the photosensitive drum 7, is applied to the transfer roller 4 illustrated in FIG. 1. By this application, the toner image on the surface of the photosensitive drum 7 is transferred onto the recording medium 2. The toner remaining on the surface of the photosensitive drum 7 after the toner image is transferred onto the recording medium 2 is swept off by the cleaning blade 11*a* serving as the cleaning unit fixed to the drum frame 11*d* by a fixation unit 11*h* illustrated in FIG. 2. Further, the toner is gathered up by the gathering sheet 11*b* to be collected into the removed toner storage unit 11*c*.

<Developer Conveyance Apparatus>

Next, a configuration of a developer conveyance device 200 will be described with reference to FIGS. 2 and 3. The developer conveyance device 200 includes the developer container 14. The developer container 14 includes the frame member 14*a*, the developer conveyance plate 14*b*, the opening member 14*c*, and the coupling member 14*d*.

The developer conveyance device 200 includes the vibration target unit 14*b*1. This vibration target unit 14*b*1 is disposed under a lower surface of the developer conveyance plate 14*b* in a protruding manner. Acceleration a of a reciprocating motion is provided to this developer conveyance plate 14*b* via this vibration target unit 14*b*1 along a developer conveyance direction J1 illustrated in FIGS. 2 and 3B. Further, the developer conveyance device 200 includes the vibration providing member 13, in which this vibration target unit 14*b*1 is detachably fitted and which is constructed with use of piezoelectric elements that vibrate this vibration target unit 14*b*1 along the developer conveyance direction J1.

Figure 3A:
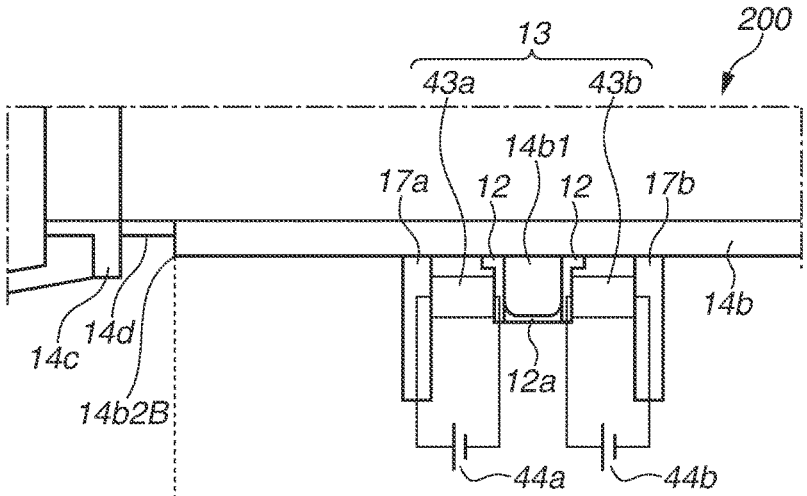
FIGS. 3A, 3B, and 3C are partial cross-sectional views illustrating how a conveyance member of the developer container according to the first exemplary embodiment is vibrated to thereby convey developer.
Figure 3B:
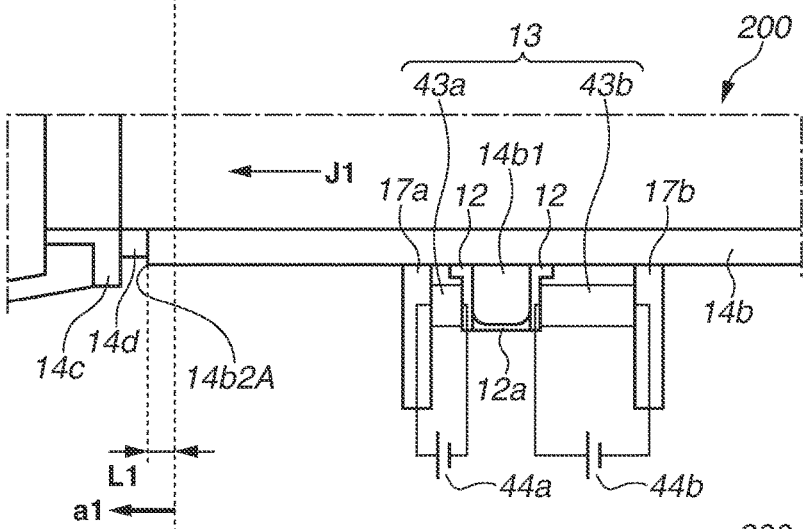
Figure 3C:
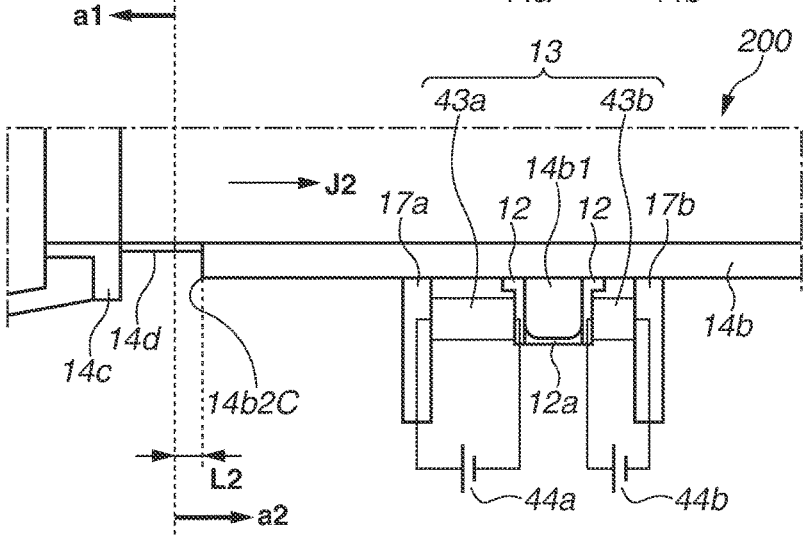

Direct-current power sources 44*a* and 44*b* illustrated in FIGS. 3A to 3C are controlled by the controller 50, which serves as the control unit. The following voltages are applied to electrodes disposed on respective both ends of a pair of piezoelectric elements 43*a* and 43*b*, which are configured as the vibration providing member 13. The controller 50 turns on and off these direct-current power sources 44*a* and 44*b* at predetermined timings to thereby cause the voltages to be applied to the electrodes. Then, the piezoelectric elements 43*a* and 43*b* are mechanically deformed according to a frequency of this switching.

This deformation causes the vibration providing member 13, which is constructed with use of the pair of piezoelectric elements 43*a* and 43*b*, to vibrate, and this vibration is transmitted to the vibration target unit 14*b*1 to thereby vibrate this vibration target unit 14*b*1 along the developer conveyance direction J1. An electrostrictive vibrator or a magnetostrictive vibrator can be used as each of the piezoelectric elements 43*a* and 43*b*.

As illustrated in FIG. 2, a reception unit 100*a*, on which the process cartridge B is to be mounted, is prepared on the main body side of the image forming apparatus 100. A recessed portion 100*b*, in which the vibration providing member 13 is disposed, is formed at this reception unit 100*a*. Support units 17*a* and 17*b* are erected in the recessed portion 100*b*. One ends of the pair of piezoelectric elements 43*a* and 43*b* are fixed to both sides of a holder unit 12, and the other ends of the pair of piezoelectric elements 43*a* and 43*b* are fixed to these support units 17*a* and 17*b*, respectively.

When the process cartridge B illustrated in FIG. 2 is mounted on the reception unit 100*a* prepared at the main body of the image forming apparatus 100, the developer conveyance device 200 is positioned in the following manner. As illustrated in FIGS. 3A to 3C, the vibration target unit 14*b*1, which is disposed under the lower surface of the developer conveyance plate 14*b* in the protruding manner, is fitted in a recessed portion 12*a* of the holder unit 12.

In the present exemplary embodiment, the developer conveyance device 200 is configured to vibrate the vibration target unit 14*b*1 using the pair of piezoelectric elements 43*a* and 43*b*, which is disposed, via the holder unit 12, on both sides of this vibration target unit 14*b*1 protruding under the lower surface of the developer conveyance plate 14*b*, along the developer conveyance direction J1 illustrated in FIG. 2.

As illustrated in FIGS. 3A to 3C, the vibration target unit 14*b*1, which protrudes under the lower surface of the developer conveyance plate 14*b*, is set up in the following manner. The vibration target unit 14*b*1 is fitted in the recessed portion 12*a* of the holder unit 12, which is disposed at the vibration providing member 13 mounted on the main body side of the image forming apparatus 100 so as to be reciprocatable in the developer conveyance direction J1 illustrated in FIG. 3B and the developer conveyance opposite direction J2 illustrated in FIG. 3C.

The individual direct-current power sources 44*a* and 44*b* are electrically connected to the electrodes disposed on the both end surfaces of the individual piezoelectric elements 43*a* and 43*b*, respectively. Then, the direct-current voltages are applied from the individual direct-current power sources 44*a* and 44*b* to the both end surfaces of the individual piezoelectric elements 43*a* and 43*b*, respectively, while being turned on/off at the predetermined timings by the controller 50 illustrated in FIG. 1, which serves as the control unit.

A direction in which the developer (the toner) placed on the developer conveyance plate 14*b* is conveyed is the developer conveyance direction J1 from the developer storage unit 14*t* toward the developing chamber 10*i* illustrated in FIG. 2 (the direction from the right side to the left side in FIG. 2).

The opening 19, which is used to supply the developer (the toner) stored in the developer storage unit 14*t* of the developer container 14 to the developing roller 10*d* in the developer conveyance direction J1 illustrated in FIG. 2, is formed at the opening member 14*c*.

As illustrated in FIG. 1, the image forming apparatus 100 is set in such a manner that the developer conveyance plate 14*b*, which forms the bottom surface of the developer container 14, is substantially horizontally arranged with the process cartridge B mounted on the main body of the image forming apparatus 100.

<Conveyance Member>

Next, a configuration of the developer conveyance plate 14*b*, which serves as the plate-shaped conveyance member, will be described. The developer conveyance plate 14*b* is the plate-shaped member disposed below the developer (the toner) and used to convey the developer (the toner). The developer conveyance plate 14*b* forms the bottom surface of the developer container 14. Further, the vibration target unit 14*b*1, to which the vibration of the vibration providing member 13 is transmitted, is disposed under the lower surface of the developer conveyance plate 14*b* in the protruding manner. A polystyrene (PS) having a thickness of approximately 1.5 mm is used as a material of the developer conveyance plate 14*b* according to the present exemplary embodiment.

<Coupling Member>

Further, as illustrated in FIG. 2, the developer conveyance plate 14*b* is connected swingably in a direction along the developer conveyance direction J1 and the developer conveyance opposite direction J2 by the frame member 14*a*, the opening member 14*c*, and the flexible coupling member 14*d* of the developer container 14. A flexible silicon rubber having a thickness of approximately 300 μm is used as a material of the coupling member 14*d* according to the present exemplary embodiment.

<Function of Conveying Developer>

Next, a function of conveying the developer by the developer conveyance device 200 will be described. In the present exemplary embodiment, the vibration providing member 13, which is constructed with use of the pair of piezoelectric elements 43*a* and 43*b*, is disposed on the main body side of the image forming apparatus 100. As illustrated in FIGS. 2 and 3A to 3C, the state in which the process cartridge B is mounted on the main body of the image forming apparatus 100 is described as follows. The vibration target unit 14*b*1, which protrudes under the lower surface of the developer conveyance plate 14*b* disposed in the process cartridge B, is fitted in the recessed portion 12*a* of the holder unit 12 of the vibration providing member 13 disposed on the main body of the image forming apparatus 100.

Then, the direct-current power sources 44*a* and 44*b* are controlled by the controller 50. The direct-current voltages are applied from these direct-current power sources 44*a* and 44*b* to the electrodes disposed on the both ends of the piezoelectric elements 43*a* and 43*b*, which are used to construct the vibration providing member 13, at the predetermined timings. This application causes the vibration providing member 13, which is constructed with use of the pair of piezoelectric elements 43*a* and 43*b*, to vibrate at a predetermined frequency, and this vibration of the vibration providing member 13 is transmitted to the developer conveyance plate 14*b* via the vibration target unit 14*b*1.

As a result, the accelerations a1 and a2 of the reciprocating motion are provided to the developer conveyance plate 14*b* along the developer conveyance direction J1 illustrated in FIGS. 2 and 3B and the developer conveyance opposite direction J2 illustrated in FIG. 3C, respectively. Then, this developer conveyance plate 14*b* is vibrated along the developer conveyance direction J1 and the developer conveyance opposite direction J2.

The process cartridge B is mounted according to an operation of attaching and detaching the process cartridge B to and from the main body of the image forming apparatus 100 in the following manner. The process cartridge B is attached to the recessed portion 12*a* of the holder unit 12 of the vibration providing member 13 disposed on the main body of this image forming apparatus 100 in the following manner. The vibration target unit 14*b*1, which protrudes under the lower surface of the developer conveyance plate 14*b* disposed in the process cartridge B, is detachably and separably fitted in the recessed portion 12*a*.

In the developer conveyance device 200 according to the present exemplary embodiment, the developing frame 10*f*1 of the developing unit 10 and the developer container 14 are integrally coupled with each other via the opening member 14*c*. Then, the developer conveyance plate 14*b*, which forms the bottom surface of the developer container 14, and the flexible coupling member 14*d* are vibrated by the vibration providing member 13 via the vibration target unit 14*b*1 disposed under this developer conveyance plate 14*b*. This configuration can improve a volume in the developer storage unit 14*t*, compared to the configuration including the member for conveying the developer (the toner) inside the developer container, such as Japanese Patent Application Laid-Open No. 2002-196585. Further, this configuration can reduce a space necessary for the swinging motion, compared to the configuration that elastically deforms an arm to thereby swing a reception plate, such as Japanese Patent Application Laid-Open No. 59-227618.

<Behavior of Developer During Vibration>

Next, a behavior of the developer (the toner) on the surface of the developer conveyance plate 14*b* will be described. First, an operation of the developer conveyance device 200 will be described with reference to FIGS. 3A to 3C. A distal end 14*b*2 of the developer conveyance plate 14*b*, which is illustrated in FIG. 2, reciprocates between the following positions by the vibration of the vibration providing member 13 via the vibration target unit 14*b*1.

The vibration target unit 14*b*1 protruding under the lower surface of the developer conveyance plate 14*b*, which is illustrated in FIG. 3A, is fitted and attached in the recessed portion 12*a* of the holder unit 12 of the vibration providing member 13 kept in a static state. At this time, the coupling member 14*d* is in a natural state without extending/compressing or swinging. The distal end 14*b*2 of the developer conveyance plate 14*b* reciprocates from an initial position 14*b*2B at this time to the following positions.

The distal end 14*b*2 of the developer conveyance plate 14*b*, which is illustrated in FIG. 2, is displaced to a position 14*b*2A, where the distal end 14*b*2 is maximally displaced in the developer conveyance direction J1 illustrated in FIG. 3B, by the vibration of the vibration providing member 13 via the vibration target unit 14*b*1. At this time, the coupling member 14*d* is in a compressed state. Further, the distal end 14*b*2 of the developer conveyance plate 14*b* is displaced to a position 14*b*2C, where the distal end 14*b*2 is maximally displaced in the developer conveyance opposite direction J2 illustrated in FIG. 3C, which is the opposite direction from the developer conveyance direction J1. At this time, the coupling member 14*d* is in an extended state. The developer conveyance plate 14*b* is configured reciprocatably between these positions. The coupling member 14*d* swings according to the reciprocating displacement of the developer conveyance plate 14*b*, which is illustrated in FIGS. 3A to 3C.

<Setting of Acceleration>

The maximum acceleration a1 (max) in the developer conveyance direction J1 illustrated in FIG. 3B, which is provided from the vibration target unit 14*b*1 with the vibration of the vibration providing member 13 transmitted thereto to the developer conveyance plate 14*b*, is set in the following manner. The maximum acceleration a1 (max) is set to a lower acceleration than the maximum acceleration a2 (max) in the developer conveyance opposite direction J2 illustrated in FIG. 3C as the opposite direction from the developer conveyance direction J1, which is provided from this vibration target unit 14*b*1 to the developer conveyance plate 14*b*.

The maximum acceleration a2 (max) of the developer conveyance plate 14*b* vibrated by the vibration providing member 13 in the developer conveyance opposite direction J2 illustrated in FIG. 3C is set in the following manner. The maximum acceleration a2 (max) is set to a maximum acceleration a (max) high enough to allow the developer (the toner) on the surface of this developer conveyance plate 14*b* to slide on the surface of this developer conveyance plate 14*b*.

The pair of piezoelectric elements 43*a* and 43*b*, which is used to construct the vibration providing member according to the present exemplary embodiment, is subject to the application of the direct-current voltages to the electrodes disposed on the respective both ends thereof at the predetermined timings. This application causes the pair of piezoelectric elements 43*a* and 43*b* to extend. The pair of piezoelectric elements 43*a* and 43*b* is made of elastic members (piezoelectric elements) that compress into their respective original sizes by a stop of the application of these direct-current voltages. A waveform of the voltage applied to each of the piezoelectric elements 43*a* and 43*b*, and the switching frequency therefor are appropriately controlled. This control can generate an acceleration difference (a1<a2) between the acceleration a1, at which the developer conveyance plate 14*b* is displaced in the developer conveyance direction J1 (a forward path), and the acceleration a2, at which the developer conveyance plate 14*b* is displaced in the developer conveyance opposite direction J2 (a backward path).

For example, suppose that the direct-current voltage to be applied to each of the piezoelectric elements 43*a* and 43*b* is set to approximately 500 V, and is set to have a square waveform at a frequency of approximately 60 Hz as a voltage waveform thereof. The direct-current voltage to be applied from the direct-current power source 44*a* to the piezoelectric element 43*a* is set to a higher voltage than the direct-current voltage to be applied from the direct-current power source 44*b* to the piezoelectric element 43*b*. This setting can generate the acceleration difference (a1<a2) between the acceleration a1, at which the developer conveyance plate 14*b* is displaced in the developer conveyance direction J1, and the acceleration a2, at which the developer conveyance plate 14*b* is displaced in the developer conveyance opposite direction J2.

This setting causes the developer (the toner) on the developer conveyance plate 14*b* to slide on the surface of this developer conveyance plate 14*b* due to its own inertia when this developer conveyance plate 14*b* is displaced in the developer conveyance opposite direction J2 illustrated in FIG. 3C. This means that the developer (the toner) on the developer conveyance plate 14*b* is relatively displaced on this developer conveyance plate 14*b* to the left side in FIG. 3C from the point of view of this developer conveyance plate 14*b*.

On the other hand, the maximum acceleration a1 (max), in the developer conveyance direction J1, of the developer conveyance plate 14*b* vibrated by the vibration providing member 13 via the vibration target unit 14*b*1 illustrated in FIG. 3B is set in the following manner. The maximum acceleration a1 (max) is set to a lower acceleration than the maximum acceleration a2 (max) in the developer conveyance opposite direction J2 illustrated in FIG. 3C. In this case, the developer (the toner) on this developer conveyance plate 14*b* is displaced integrally with this developer conveyance plate 14*b* without sliding on the surface of this developer conveyance plate 14*b*.

Repetition of such vibrations causes the developer (the toner) on this developer conveyance plate 14*b* to be conveyed on the surface of this developer conveyance plate 14*b* in the developer conveyance direction J1 illustrated in FIG. 3B.

<Condition for Sliding Motion of Developer>

The developer (the toner) on the surface of the developer conveyance plate 14*b* slides on the surface of this developer conveyance plate 14*b* when a certain condition is satisfied. Next, this condition will be described. The developer (the toner) on the surface of the developer conveyance plate 14*b* slides on the surface of this developer conveyance plate 14*b* under the following condition. Assume that μ0 represents a static friction coefficient between the surface of this developer conveyance plate 14*b* and the developer (the toner), g represents a gravitational acceleration, and {μ0×g} is a product of these static friction coefficient μ0 and gravitational acceleration g.

Then, the vibration providing member 13 is vibrated with the developer (the toner) placed on the surface of the developer conveyance plate 14*b*. The acceleration a1, at which this developer conveyance plate 14*b* is driven to reciprocate along the developer conveyance direction J1 illustrated in FIG. 3B by the vibration of the vibration providing member 13 via the vibration target unit 14*b*1, is set so as to be higher than {μ0×g}. Alternatively, the acceleration a2, at which the developer conveyance plate 14*b* is driven to reciprocate along the developer conveyance opposite direction J2 illustrated in FIG. 3C, is set so as to be higher than the product {ρ0×g}. This setting causes the developer (the toner) on the surface of the developer conveyance plate 14*b* to slide on the surface of this developer conveyance plate 14*b*.

<Capability to Convey Developer>

Next, consideration is to be made on the maximum acceleration a1 (max), at which this developer conveyance plate 14*b* is displaced by the vibration of the vibration providing member 13 in the developer conveyance direction J1 illustrated in FIG. 3B. Further, consideration is to be made on the maximum acceleration a2 (max), at which this developer conveyance plate 14*b* is displaced by the vibration of the vibration providing member 13 in the developer conveyance opposite direction J2 illustrated in FIG. 3C. Further, consideration is to be made on {μ0×g}, which is the product of the static friction coefficient ρ0 between the surface of the developer conveyance plate 14*b* and the developer (the toner) and the gravitational acceleration g. A relationship among them, and a capability to convey the developer (the toner) on the surface of this developer conveyance plate 14*b* will be described now.

<Acceleration Condition Capable of Causing Conveyance of Developer>

Consideration is to be made on the maximum acceleration a1 (max), at which this developer conveyance plate 14*b* is displaced by the vibration of the vibration providing member 13 in the developer conveyance direction J1 illustrated in FIG. 3B. Further, consideration is to be made on the maximum acceleration a2 (max), at which the developer conveyance plate 14*b* is displaced in the developer conveyance opposite direction J2 illustrated in FIG. 3C. Then, the maximum acceleration a1 (max) and the maximum acceleration a2 (max) are in the following relationship with each other. The relationship between the maximum acceleration a1 (max) and the maximum acceleration a2 (max) may be expressed by the following expression, an expression 1, with use of the product {μ0×g} of the static friction coefficient μ0 between the surface of the developer conveyance plate 14*b* and the developer (the toner), and the gravitational acceleration g.

$$\{\mu 0 \times g\} < a1(\max) < a2(\max) \quad \text{[Expression 1]}$$

The case in which the maximum accelerations a1 (max) and a2 (max) are in the relationship expressed by the above-described expression 1 is as follows. The developer conveyance plate 14*b* is displaced at the maximum acceleration a1 (max) by the vibration of the vibration providing member 13 in the developer conveyance direction J1 illustrated in FIG. 3B. Further, the developer conveyance plate 14*b* is displaced at the maximum acceleration a2 (max) in the developer conveyance opposite direction J2 illustrated in FIG. 3C. At this time, the developer conveyance plate 14*b* is displaced in the developer conveyance opposite direction J2 illustrated in FIG. 3C. In such a case, the developer (the toner) sliding on the surface of this developer conveyance plate 14*b* is relatively displaced on the surface of this developer conveyance plate 14*b* in the developer conveyance direction J1 illustrated in FIG. 3B.

In other words, the developer (the toner) on the surface of the developer conveyance plate 14*b* is displaced on the surface of the developer conveyance plate 14*b* in both the developer conveyance direction J1 illustrated in FIG. 3B and the developer conveyance opposite direction J2 illustrated in FIG. 3C. In this case, the maximum accelerations a1 (max) and a2 (max) are set so as to satisfy {a1 (max)<a2 (max)} as indicated in the above-described expression 1.

Therefore, seen from the developer conveyance plate 14*b*, the developer (the toner) is relatively displaced by the following distance (a distance by which the developer (the toner) slides on the surface of the developer conveyance plate 14*b*). The developer (the toner) is relatively displaced by a longer distance when the developer conveyance plate 14*b* is displaced in the developer conveyance opposite direction J2 illustrated in FIG. 3C, compared to when this developer conveyance plate 14*b* is displaced in the developer conveyance direction J1 illustrated in FIG. 3B.

Therefore, the conveyance of the developer is carried out in the following manner if the maximum accelerations a1 (max) and a2 (max) are set so as to satisfy {a1 (max)<a2 (max)} as indicated in the above-described expression 1. The developer conveyance plate 14*b* is provided with the maximum acceleration a1 (max) at which this developer conveyance plate 14*b* is displaced, by the vibration of the vibration providing member 13, in the developer conveyance direction J1 illustrated in FIG. 3B. Further, the developer conveyance plate 14*b* is provided with the maximum acceleration a2 (max) at which this developer conveyance plate 14*b* is displaced, by the vibration of the vibration providing member 13, in the developer conveyance opposite direction J2 illustrated in FIG. 3C.

Then, this developer conveyance plate 14*b* is provided with the maximum acceleration a1 (max), at which the developer conveyance plate 14*b* is displaced in the developer conveyance direction J1 illustrated in FIG. 3B, and further provided with the maximum acceleration a2 (max), at which the developer conveyance plate 14*b* is displaced in the developer conveyance opposite direction J2 illustrated in FIG. 3C. The developer conveyance plate 14*b* is provided with these accelerations repeatedly. This operation allows the developer (the toner) on the surface of the developer conveyance plate 14*b* to be displaced in the developer conveyance direction J1 illustrated in FIG. 3B.

<Acceleration Condition for Increasing Amount of Conveyance of Developer>

Consideration is to be made on the maximum acceleration a1 (max) at which this developer conveyance plate 14*b* is displaced, by the vibration of the vibration providing member 13, in the developer conveyance direction J1 illustrated in FIG. 3B. Further, consideration is to be made on the maximum acceleration a2 (max) at which the developer conveyance plate 14*b* is displaced in the developer conveyance opposite direction J2 illustrated in FIG. 3C. Then, the maximum acceleration a1 (max) and the maximum acceleration a2 (max) are in the following relationship with each other. The relationship between the maximum acceleration a1 (max) and the maximum acceleration a2 (max) may be expressed by the following expression, an expression 2, with use of the product {μ0×g} of the static friction coefficient μ0 between the surface of the developer conveyance plate 14*b* and the developer (the toner), and the gravitational acceleration g.

$$a1(\max)<\{\mu 0\times g\}<a2(\max) \quad \text{[Expression 2]}$$

If the maximum accelerations a1 (max) and a2 (max) are in the relationship expressed by the above-described expression 2, the maximum acceleration a1 (max) set to a lower acceleration than {μ0×g} is provided when the developer conveyance plate 14*b* is displaced by the vibration of the vibration providing member 13 in the developer conveyance direction J1 illustrated in FIG. 3B. This setting prohibits the developer (the toner) from being relatively displaced on the surface of the developer conveyance plate 14*b* in the developer conveyance opposite direction J2 illustrated in FIG. 3C.

Then, the maximum acceleration a2 (max) set to a higher acceleration than {μ0×g} is provided when the developer conveyance plate 14*b* is displaced in the developer conveyance opposite direction J2 illustrated in FIG. 3C. This setting causes the developer (the toner) to be relatively displaced on the surface of the developer conveyance plate 14*b* in the developer conveyance direction J1 illustrated in FIG. 3B.

In other words, the following result is acquired even when the developer conveyance plate 14*b* is displaced so as to follow the same track (displaced by the same distance) between a forward motion and a backward motion of a single reciprocation in the developer conveyance direction J1 illustrated in FIG. 3B and the developer conveyance opposite direction J2 illustrated in FIG. 3C. Consideration is to be made on the maximum acceleration a1 (max) at which this developer conveyance plate 14*b* is displaced, by the vibration of the vibration providing member 13, in the developer conveyance direction J1 illustrated in FIG. 3B. Further, consideration is to be made on the maximum acceleration a2 (max) at which the developer conveyance plate 14*b* is displaced in the developer conveyance opposite direction J2 illustrated in FIG. 3C. Then, the maximum acceleration a1 (max) and the maximum acceleration a2 (max) are set as indicated in the above-described expression 2.

This setting causes the developer conveyance plate 14*b* to be displaced in the developer conveyance direction J1 illustrated in FIG. 3B and the developer conveyance opposite direction J2 illustrated in FIG. 3C. During this single reciprocation, the developer (the toner) on the surface of this developer conveyance plate 14*b* can be conveyed by a larger amount (a longer distance) in the developer conveyance direction J1 illustrated in FIG. 3B.

<Acceleration Condition Incapable of Causing Conveyance of Developer>

On the other hand, consideration is to be made on the maximum acceleration a1 (max) at which this developer conveyance plate 14*b* is displaced, by the vibration of the vibration providing member 13, in the developer conveyance direction J1 illustrated in FIG. 3B. Further, consideration is to be made on the maximum acceleration a2 (max) at which the developer conveyance plate 14*b* is displaced in the developer conveyance opposite direction J2 illustrated in FIG. 3C. Then, the relationship between the maximum acceleration a1 (max) and the maximum acceleration a2 (max) may be expressed by the following expression, an expression 3, with use of the product {μ0×g} of the static friction coefficient μ0 between the surface of the developer conveyance plate 14*b* and the developer (the toner), and the gravitational acceleration g.

$$a1(\max)<a2(\max)<\{\mu 0\times g\} \quad \text{[Expression 3]}$$

If the maximum accelerations a1 (max) and a2 (max) are in the relationship expressed by the above-described expression 3, the developer (the toner) does not slide on the surface of the developer conveyance plate 14*b* by the vibration of the vibration providing member 13. Therefore, the developer (the toner) cannot be conveyed. In other words, the developer conveyance plate 14*b* is displaced, by the vibration of the vibration providing member 13, in the developer conveyance opposite direction J2 illustrated in FIG. 3C.

At this time, the maximum acceleration a2 (max) is set so as to cause the developer (the toner) to slide on the surface of this developer conveyance plate 14*b*. In such a case, the maximum acceleration a2 (max) at which this developer conveyance plate 14*b* is displaced, by the vibration of the vibration providing member 13, in the developer conveyance opposite direction J2 illustrated in FIG. 3C should be set as indicated in the following expression, an expression 4.

$$\{\mu 0\times g\}<a2(\max) \quad \text{[Expression 4]}$$

The following static friction coefficient μ0 is established between the surface of the developer conveyance plate 14*b* and the developer (the toner). The surface of this developer conveyance plate 14*b* is being inclined at an inclination angle θ with respect to a horizontal plane with the developer (the toner) placed on the surface of this developer conveyance plate 14*b*. The static friction coefficient μ0 can be calculated by the following expression, an expression 5, with use of the inclination angle θ defined between the horizontal plane and the surface of the developer conveyance plate 14*b* when the developer (the toner) slides down on the surface of this developer conveyance plate 14*b* at this time.

$$\mu 0=\tan\theta \quad \text{[Expression 5]}$$

At this time, the developer (the toner) on the surface of the developer conveyance plate 14*b* slides down from the surface of this developer conveyance plate 14*b* due to a slide generated at an interface between the surface of this developer conveyance plate 14*b* and the developer (the toner), and a slide generated at an interface between particles of the developer (the toner).

In other words, the following fact can be said with respect to the slide of the developer (the toner) relative to the surface of the developer conveyance plate 14*b* vibrated by the vibration providing member 13. This slide is not limited to the slide generated at the interface between the surface of this developer conveyance plate 14*b* and the developer (the toner). Besides that, this slide also includes the slide generated at the interface between the particles of the developer (the toner) above the surface of this developer conveyance plate 14*b*.

The developer (the toner) on the surface of the developer conveyance plate 14*b* is conveyed in the developer conveyance direction J1 illustrated in FIG. 3B by this developer conveyance plate 14*b* vibrated by the vibration providing member 13 according to the present exemplary embodiment. In the present exemplary embodiment, the vibration providing member 13 is driven at a frequency of 20 Hz. A displacement distance L1+L2 of the distal end 14b2 of the developer conveyance plate 14b, which is expressed by a difference between the position 14b2A and the position 14b2C of the distal end 14b2 of this developer conveyance plate 14b illustrated in FIGS. 3B and 3C, respectively, is set to approximately 3 mm.

The material of the developer conveyance plate 14b does not necessarily have to be limited to the polystyrene. For example, polyethylene terephthalate (PET), polyethylene (PE), and polypropylene (PP) can be used as the material of the developer conveyance plate 14b.

Further, an acrylonitrile butadiene styrene copolymer (ABS) resin can be used as the material of the developer conveyance plate 14b. Further, a commonly-used plastic material, such as polycarbonate (PC) and polyacetal (polyoxymethylene (POM)), can be used as the material of the developer conveyance plate 14b.

The material of the flexible coupling member 14d does not necessarily have to be limited to the silicon rubber. For example, a commonly-used elastomer material, such as an acrylic rubber, a natural rubber, and a butyl rubber, can be used as the material of the coupling member 14d. Further, polypropylene (PP), polyethylene (PE), and a polyamide fiber, such as nylon (a trade name), can be used as the material of the coupling member 14d. Further, an aluminum foil, a film, paper, and the like can also be used as the material of the coupling member 14d.

According to the present exemplary embodiment, a dead space can be reduced inside the developer storage unit 14t, and the developer container 14 is thereby able to convey the developer (the toner) inside this developer storage unit 14t with an improved conveyance capability. More specifically, the horizontally extending developer conveyance plate 14b, which forms the bottom surface of the developer container 14, is vibrated by the vibration providing member 13 via the vibration target unit 14b1. By this vibration, the developer (the toner) in the developer storage unit 14t is conveyed toward the opening 19. This conveyance allows the developer (the toner) to be stably supplied to the developing roller 10d. Further, the dead space can be reduced in the path along which the developer is conveyed.

Figure 4:
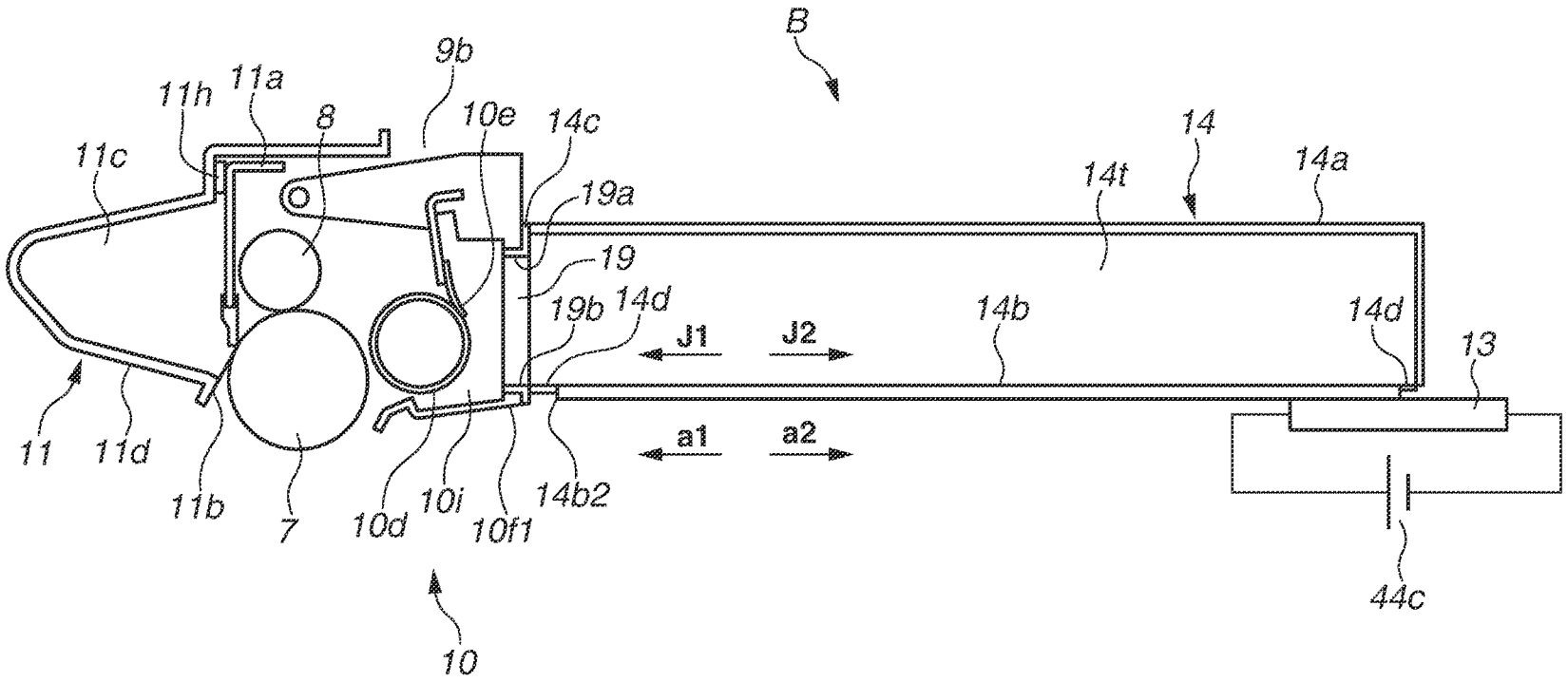
FIG. 4 is an illustrative cross-sectional view illustrating a configuration of a second exemplary embodiment of the process cartridge including the developing apparatus equipped with the developer container according to an exemplary embodiment of the present invention.

FIG. 4 relates to a second embodiment of the image forming apparatus on which the process cartridge including the developing apparatus equipped with the developer container according to one of the exemplary embodiments of the present invention is detachably mounted. Next, a configuration of this second exemplary embodiment will be described with reference to FIG. 4. Components configured similarly to the above-described first exemplary embodiment will be identified by the same reference numerals or the same member names even if the reference numerals are different, and descriptions thereof will be omitted below.

In the above-described first exemplary embodiment, the developer conveyance device 200 is configured to vibrate the vibration target unit 14b1, which protrudes under the lower surface of the developer conveyance plate 14b, by the vibration providing member 13, which is constructed with use of the pair of piezoelectric elements 43a and 43b, via the holder unit 12.

In the present exemplary embodiment, as illustrated in FIG. 4, the developer conveyance plate 14b, which serves as the conveyance member, and one end of the vibration providing member 13, which is constructed with use of piezoelectric elements, are coupled with each other. The other end of this vibration providing member 13 is coupled to the main body of the image forming apparatus 100. Then, a direct-current power source 44c is electrically connected to electrodes disposed on the both ends of this vibration providing member 13. Then, similarly to the above-described first exemplary embodiment, the direct-current power source 44c is controlled by the controller 50 illustrated in FIG. 1, which serves as the control unit, thereby turning on/off a direct-current voltage to be applied to the electrodes disposed on the both ends of the vibration providing member 13 at a predetermined timing.

For example, a slowly increasing direct-current voltage is applied from the direct-current power source 44c to the electrodes disposed on the both ends of the vibration providing member 13. This application allows the acceleration a1, at which the developer conveyance plate 14b is displaced in the developer conveyance direction J1 (the forward path), to be provided as a low acceleration. Further, the direct-current voltage applied to the electrodes disposed on the both ends of this vibration providing member 13 is suddenly dropped. This adjustment allows the acceleration a2, at which the developer conveyance plate 14b is displaced in the developer conveyance opposite direction J2 (the backward path), to be provided as a high acceleration.

This control can generate an acceleration difference (a1<a2) between the acceleration a1, at which the developer conveyance plate 14b is displaced in the developer conveyance direction J1 (the forward path), and the acceleration a2, at which the developer conveyance plate 14b is displaced in the developer conveyance opposite direction J2 (the backward path). Other features are configured similarly to any of the above-described exemplary embodiments, whereby the present exemplary embodiment can bring about similar effects.

FIGS. 5 and 6A to 6C relate to a third exemplary embodiment of the image forming apparatus on which the process cartridge including the developing apparatus equipped with the developer container according to one of the exemplary embodiments of the present invention is detachably mounted. Next, a configuration of this third exemplary embodiment will be described with reference to FIGS. 5 and 6A to 6C. Components configured similarly to any of the above-described exemplary embodiments will be identified by the same reference numerals or the same member names even if the reference numerals are different, and descriptions thereof will be omitted below.

In each of the above-described exemplary embodiments, the vibration providing member 13, which vibrates the developer conveyance plate 14b in the developer conveyance direction J1 and the developer conveyance opposite direction J2 while the developer (the toner) in the developer container 14 is placed on the developer conveyance plate 14b, is constructed with use of the piezoelectric element(s).

Figure 5:
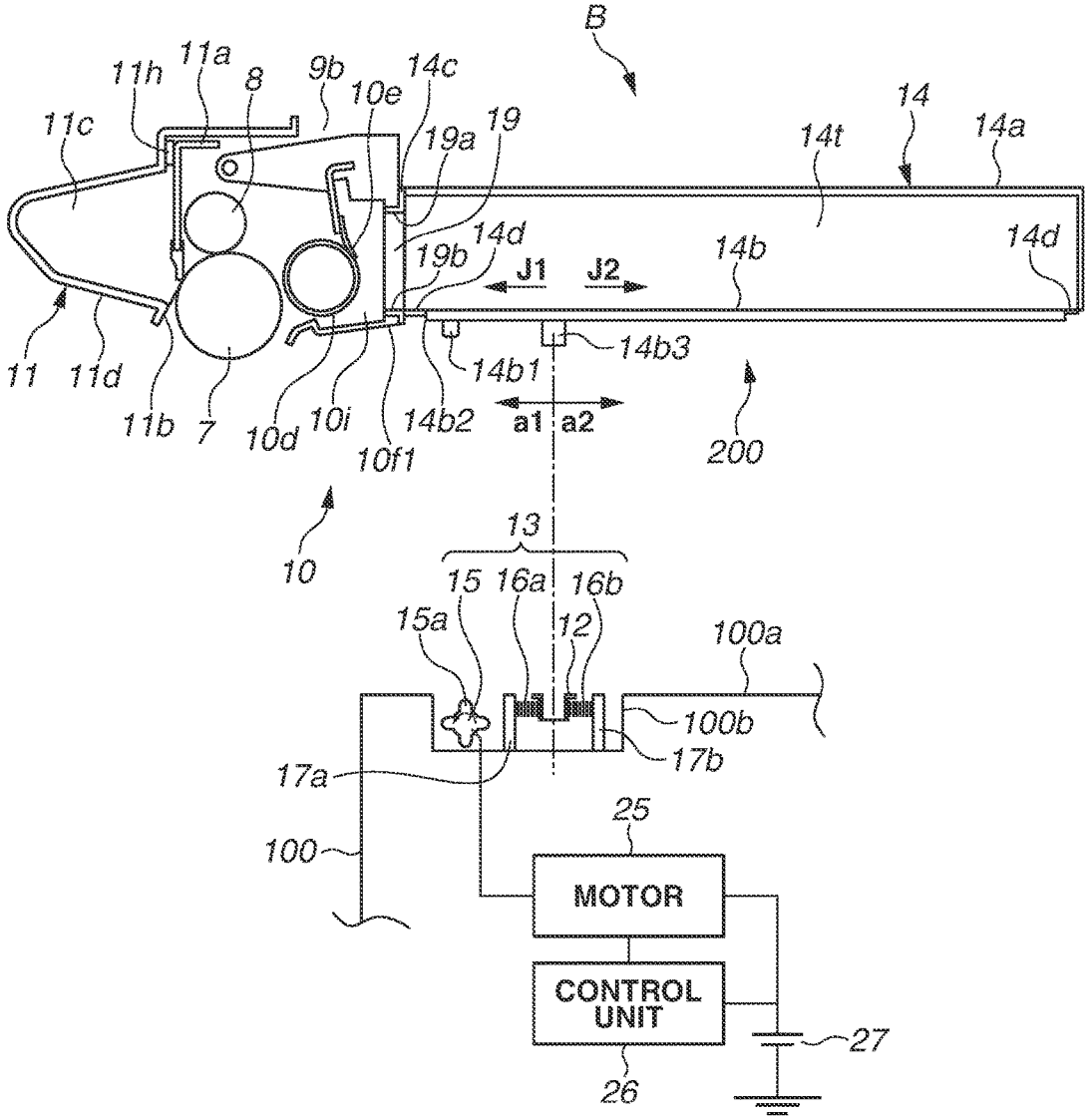
FIG. 5 is an illustrative cross-sectional view illustrating a configuration of a third exemplary embodiment of the process cartridge including the developing apparatus equipped with the developer container according to an exemplary embodiment of the present invention, and the image forming apparatus on which this process cartridge is to be mounted.
Figure 6A:
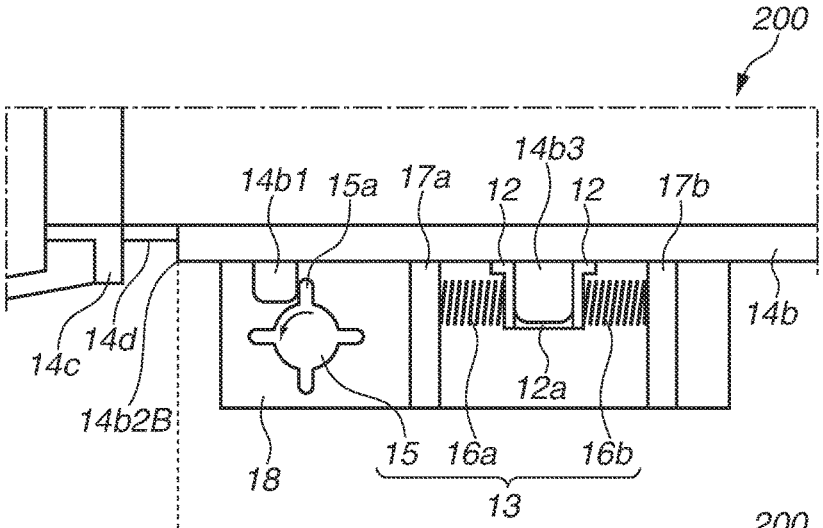
FIGS. 6A, 6B, and 6C are partial cross-sectional views illustrating how the conveyance member of the developer container according to the third exemplary embodiment is vibrated to thereby convey the developer.
Figure 6B:
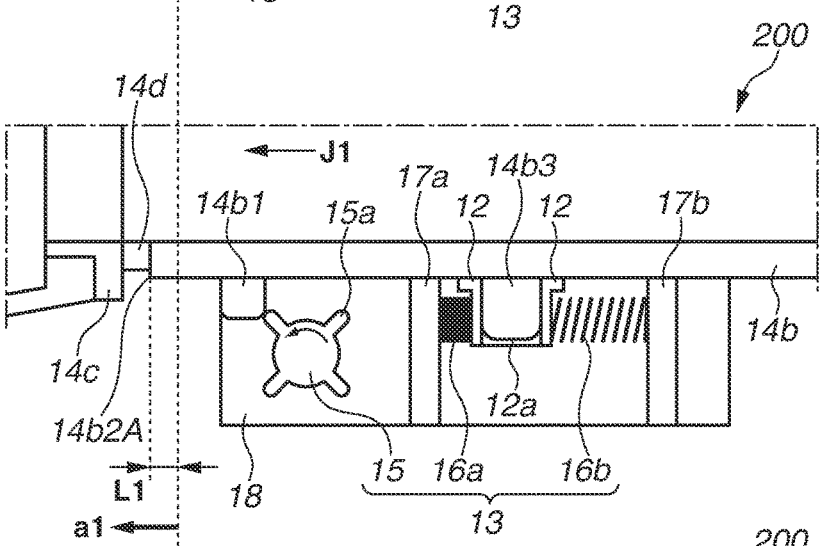

In the present exemplary embodiment, as illustrated in FIGS. 5 and 6A to 6C, vibration target units 14b1 and 14b3 are disposed under the lower surface of the developer conveyance plate 14b in a protruding manner. Then, the vibration providing member 13, which vibrates these vibration target units 14b1 and 14b3 along the developer conveyance direction J1 illustrated in FIGS. 5 and 6B, is configured in the following manner.

As illustrated in FIG. 5, the reception unit 100a, on which the process cartridge B is mounted, is prepared on the main body side of the image forming apparatus 100. The recessed portion 100b, in which the vibration providing member 13 is disposed, is formed at this reception unit 100a. The support units 17a and 17b are erected in the recessed portion 100b. One ends of biasing members 16a and 16b made of a pair of coil springs are engaged with the both sides of the holder unit 12, and the other ends of the biasing members 16*a* and 16*b* are engaged with these support units 17*a* and 17*b*, respectively.

Further, a cam member 15, which is supported rotatably about an axis by a not-illustrated support unit, is disposed in the recessed portion 100*b*. The cam member 15 is rotationally driven by a motor 25 controlled by a control unit 26, with the motor 25 and the control unit 26 serving as the driving source and the control unit, respectively. A power source 27 supplies power to each of the control unit 26 and the motor 25.

Figure 6C:
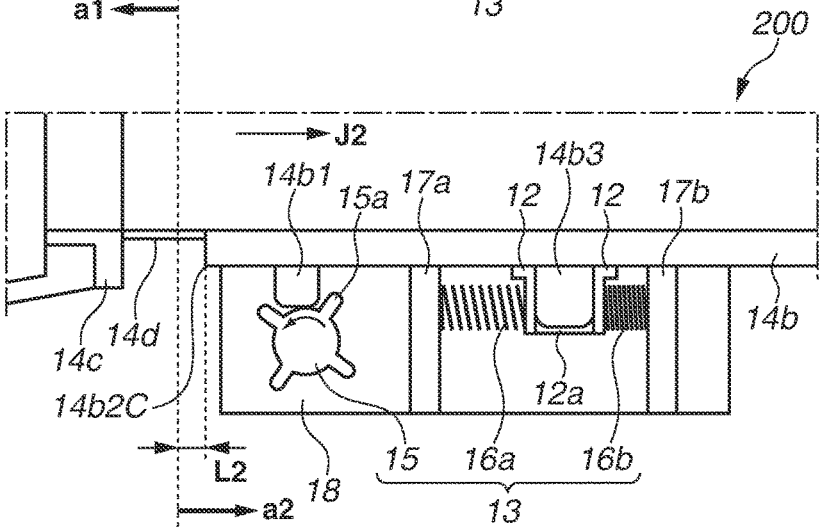

When the process cartridge B illustrated in FIG. 5 is mounted on the reception unit 100*a* prepared on the main body of the image forming apparatus 100, the developer conveyance device 200 is positioned in the following manner. As illustrated in FIGS. 6A to 6C, the vibration target unit 14*b*1, which is disposed under the lower surface of the developer conveyance plate 14*b* in the protruding manner, is set up at a position that allows abutment portions 15*a* of the cam member 15 to abut against the vibration target unit 14*b*1. On the other hand, the vibration target unit 14*b*3, which is disposed under the lower surface of the developer conveyance plate 14*b* in the protruding manner, is fitted in the recessed portion 12*a* of the holder unit 12.

The vibration providing member 13 of the present exemplary embodiment includes a cam member 15, which periodically pushes the vibration target unit 14*b*1 in the developer conveyance direction J1 illustrated in FIGS. 5 and 6B. Further, the vibration providing member 13 includes biasing members 16*a* and 16*b*, which are made of coil springs that exert a biasing force in the developer conveyance opposite direction J2 illustrated in FIGS. 5 and 6C when the abutment portions 15*a* of the cam member 15 are separated from the vibration target unit 14*b*1. The developer conveyance opposite direction J2 illustrated in FIG. 6C is the opposite direction from the developer conveyance direction J1 illustrated in FIG. 6B.

In the present exemplary embodiment, a motor 25, which serves as a driving source, is driven and controlled by the controller 26 illustrated in FIG. 5, which serves as the control unit. Then, the cam member 15 illustrated in FIGS. 5 and 6A to 6C is rotationally driven by this motor 25. As a result of this, each of the abutment portions 15*a* of this cam member 15, which protrudes in four directions offset by 90 degrees for each of them in a radial direction of this cam member 15, respectively, abuts against and pushes the vibration target unit 14*b*1, which is disposed under the lower surface of the developer conveyance plate 14*b* in the protruding manner, per predetermined cycle.

On the other hand, the vibration target unit 14*b*3, which is disposed under the lower surface of the developer conveyance plate 14*b* in the protruding manner, is subject to a stretching force and a tensile force (the biasing force) of the biasing members 16*a* and 16*b* disposed on both sides of this vibration target unit 14*b*3. Then, the vibration target unit 14*b*3 is biased in each of the developer conveyance direction J1 and the developer conveyance opposite direction J2 illustrated in FIG. 5.

As a result, the developer conveyance plate 14*b* can be vibrated in the developer conveyance direction J1 and the developer conveyance opposite direction J2, via the vibration target units 14*b*1 and 14*b*3.

<Developer Conveyance Device>

A configuration of the developer conveyance device 200 according to the present exemplary embodiment will be described with reference to FIGS. 5 and 6. As illustrated in FIGS. 5 and 6A to 6C, the vibration target unit 14*b*3 is disposed in the protruding manner under the lower surface of the developer conveyance plate 14*b* disposed in the developer conveyance device 200 according to the present exemplary embodiment.

The vibration target unit 14*b*3 is fitted in the recessed portion 12*a* of the holder unit 12, which is disposed in the vibration providing member 13 provided on the main body side of the image forming apparatus 100 so as to be reciprocatable in the developer conveyance direction J1 and the developer conveyance opposite direction J2 illustrated in FIG. 5. One ends of the biasing members 16*a* and 16*b* made of the coil springs are engaged with the support units 17*a* and 17*b*, respectively, and the other ends of the biasing members 16*a* and 16*b* are engaged with the both side surfaces of this holder unit 12.

Due to this configuration, the biasing force constituted by the stretching force and the tensile force of the biasing members 16*a* and 16*b* is applied to the developer conveyance plate 14*b* via the holder unit 12 and the vibration target unit 14*b*3 in the following manner. The biasing force is applied in each of the developer conveyance direction J1 and the developer conveyance opposite direction J2 illustrated in FIG. 5.

The vibration providing member 13 includes the cam member 15, which is rotationally driven in the counterclockwise direction illustrated in FIGS. 5 and 6A to 6C by the motor 25 illustrated in FIG. 5 serving as the driving source. The cam member 15 according to the present exemplary embodiment includes the abutment portions 15*a*, which protrude in the four directions radially offset by 90 degrees for each of them.

The cam member 15 is rotationally driven in the counterclockwise direction illustrated in FIGS. 5 and 6A to 6C. When the cam member 15 is rotationally driven in the counterclockwise direction illustrated in FIGS. 5 and 6A to 6C, each of the abutment portions 15*a* of this cam member 15 abuts against and pushes the vibration target unit 14*b*1, which is disposed under the lower surface of the developer conveyance plate 14*b* in the protruding manner, per predetermined cycle.

The vibration target unit 14*b*1, which protrudes under the lower surface of the developer conveyance plate 14*b*, is pushed by each of the abutment portions 15*a* of the cam member 15 rotationally driven in the counterclockwise direction illustrated in FIG. 6A. This push causes the developer conveyance plate 14*b* to be displaced in the developer conveyance direction J1 illustrated in FIG. 6B, against the stretching force of the biasing member 16*a* and the tensile force of the biasing member 16*b*.

After that, as illustrated in FIG. 6C, the abutment portion 15*a* pushing the vibration target unit 14*b*1 is disengaged from this vibration target unit 14*b*1. Then, the developer conveyance plate 14*b* is displaced in the developer conveyance opposite direction J2 illustrated in FIG. 6C due to the stretching force of the biasing member 16*a* and the tensile force of the biasing member 16*b* via the holder unit 12 and the vibration target unit 14*b*3.

The cam member 15 is continuously rotationally driven in the counterclockwise direction illustrated in FIG. 6A. This continuous rotation causes each of the abutment portions 15*a* of this cam member 15 to sequentially push the vibration target unit 14*b*1 protruding under the lower surface of the developer conveyance plate 14*b*. This is followed by repetition of the operation of disengaging each of the abutment portions 15*a*, which has been pushing the vibration target unit 14*b*1, from this vibration target unit 14*b*1. As a result, the developer conveyance plate 14*b* is vibrated in the developer conveyance direction J1 and the developer conveyance opposite direction J2 illustrated in FIG. 5. The vibration providing member 13 according to the present exemplary embodiment is constructed with use of the cam member 15, the biasing members 16*a* and 16*b*, and the like.

<Function of Conveying Developer>

Next, a function of conveying the developer by the developer conveyance device 200 according to the present exemplary embodiment will be described. In the present exemplary embodiment, a vibration device 18, which includes the cam member 15 and the biasing members 16*a* and 16*b* used to construct the vibration providing member 13, is disposed on the main body side of the image forming apparatus 100. Each of the abutment portions 15*a* of the cam member 15 abuts against and pushes the vibration target unit 14*b*1 protruding under the lower surface of the developer conveyance plate 14*b*. Further, when each of the abutment portions 15*a* of the cam member 15 is disengaged from the vibration target unit 14*b*1, the stretching force of the biasing member 16*a* and the tensile force of the biasing member 16*b* are each applied to the vibration target unit 14*b*3, which protrudes under the lower surface of the developer conveyance plate 14*b*, via the holder unit 12.

This operation allows the maximum accelerations a1(max) and a2 (max) of the reciprocating motion to be provided in the developer conveyance direction J1 illustrated in FIG. 6B and the developer conveyance opposite direction J2 illustrated in FIG. 6C, respectively, to thereby vibrate the developer conveyance plate 14*b*.

In the present exemplary embodiment, the maximum acceleration a1 (max) in the developer conveyance direction J1 illustrated in FIG. 6B, which is provided from the vibration target units 14*b*1 and 14*b*3 protruding under the lower surface of the developer conveyance plate 14*b* to this developer conveyance plate 14*b*, is also set in the following manner. The maximum acceleration a1 (max) is set to a lower acceleration than the maximum acceleration a2 (max) provided from these vibration target units 14*b*1 and 14*b*3 to this developer conveyance plate 14*b* in the developer conveyance opposite direction J2 illustrated in FIG. 6C. The developer conveyance opposite direction J2 is the opposite direction from the developer conveyance direction J1 illustrated in FIG. 6B.

In the present exemplary embodiment, the process cartridge B is mounted in the following manner according to an operation of attaching and detaching the process cartridge B to and from the main body of the image forming apparatus 100. The vibration target unit 14*b*1, which protrudes under the lower surface of the developer conveyance plate 14*b*, is detachably mounted at a position that allows the abutment portions 15*a* of the cam member 15 disposed on the main body side of the image forming apparatus 100 to abut against the vibration target unit 14*b*1. Further, the vibration target unit 14*b*3, which protrudes under the lower surface of the developer conveyance plate 14*b*, is detachably fitted into the recessed portion 12*a* of the holder unit 12 with the biasing members 16*a* and 16*b* coupled therewith.

The cam member 15 is rotated in the counterclockwise direction illustrated in FIGS. 5 and 6A to 6C by the not-illustrated motor serving as the driving source mounted on the main body of the image forming apparatus 100. This rotation causes one of the abutment portions 15*a* of the cam member 15 to push the vibration target unit 14*b*1, which protrudes under the lower surface of the developer conveyance plate 14*b*, against the stretching force of the biasing member 16*a* and the tensile force of the biasing member 16*b*. This push causes the distal end 14*b*2 of the developer conveyance plate 14*b*, which is illustrated in FIG. 5, to be displaced in the developer conveyance direction J1 from the initial position 14*b*2B illustrated in FIG. 6A to the position 14*b*2A illustrated in FIG. 6B.

At this time, at least a part of the developer (the toner) on the surface of the developer conveyance plate 14*b* is displaced integrally with this developer conveyance plate 14*b* without sliding on the surface of this developer conveyance plate 14*b*. After that, as illustrated in FIG. 6C, the one of the abutment portions 15*a* of the cam member 15 is disengaged from the vibration target unit 14*b*1. At this time, the maximum acceleration a2 (max) is provided to the vibration target unit 14*b*3, which protrudes under the lower surface of the developer conveyance plate 14*b*, in the developer conveyance opposite direction J2 illustrated in FIG. 6C via the holder unit 12 due to the stretching force of the biasing member 16*a* and the tensile force of the biasing member 16*b*.

This push causes the distal end 14*b*2 of the developer conveyance plate 14*b*, which is illustrated in FIG. 5, to be displaced in the developer conveyance opposite direction J2 from the position 14*b*2A illustrated in FIG. 6B to the position 14*b*2C illustrated in FIG. 6C. At this time, the developer (the toner) on the surface of the developer conveyance plate 14*b* slides on the surface of this developer conveyance plate 14*b*. Further, the biasing members 16*a* and 16*b* also have a function as a damper.

More specifically, the vibration target unit 14*b*3, which protrudes under the lower surface of the developer conveyance plate 14*b*, receives a restorative force due to the elastic forces of the biasing members 16*a* and 16*b* via the holder unit 12. As this restorative force, the vibration target unit 14*b*3 alternately receives the biasing forces (the stretching forces and the tensile forces) in the developer conveyance direction J1 illustrated in FIG. 6B and the developer conveyance opposite direction J2 illustrated in FIG. 6C. Eventually, the vibration of the developer conveyance plate 14*b* diminishes, so that the distal end 14*b*2 of this developer conveyance plate 14*b* returns to the initial position 14*b*2B illustrated in FIG. 6A.

In the present exemplary embodiment, the distal end 14*b*2 of the developer conveyance plate 14*b* is displaced under the action of the cam member 15 and the biasing members 16*a* and 16*b*, which are used to construct the vibration providing member 13, in the following manner. Consideration is to be made on the initial position 14*b*2B illustrated in FIG. 6A. Further, consideration is to be made on the position 14*b*2A, to which the distal end 14*b*2 of the developer conveyance plate 14*b* is maximally displaced in the developer conveyance direction J1 illustrated in FIG. 6B. Further, consideration is to be made on the position 14*b*2C, to which the distal end 14*b*2 of the developer conveyance plate 14*b* is maximally displaced in the developer conveyance opposite direction J2 illustrated in FIG. 6C. Then, the developer conveyance device 200 is configured in such a manner that the distal end 14*b*2 of the developer conveyance plate 14*b* is reciprocatable between the initial position 14*b*2B, and the positions 14*b*2A and 14*b*2C.

The developer conveyance plate 14*b* is displaced at the maximum acceleration a1 (max) in the developer conveyance direction J1 illustrated in FIG. 6B, and is further displaced at the maximum acceleration a2 (max) in the developer conveyance opposite direction J2 illustrated in FIG. 6C, under the action of the cam member 15 and the biasing members 16*a* and 16*b*.

<Setting of Acceleration>

The maximum acceleration a2 (max) of the developer conveyance plate 14*b* in the developer conveyance opposite direction J2 illustrated in FIG. 6C, which is provided by the vibration providing member 13 constructed with use of the cam member 15 and the biasing members 16*a* and 16*b*, can be adjusted in the following manner. The maximum acceleration a2 (max) can be set to the acceleration that allows the developer (the toner) on the surface of this developer conveyance plate 14*b* to slide on the surface of this developer conveyance plate 14*b*, by appropriately adjusting the biasing force of the biasing members 16*a* and 16*b*.

On the other hand, the maximum acceleration a1 (max) of the developer conveyance plate 14*b* in the developer conveyance direction J1 illustrated in FIG. 6B, which is provided by the vibration providing member 13, is set in the following manner. The maximum acceleration a1 (max) can be set to a lower acceleration than the maximum acceleration a2 (max) in the developer conveyance opposite direction J2 illustrated in FIG. 6C, by appropriately adjusting the number of rotations of the cam member 15.

The developer (the toner) on the surface of the developer conveyance plate 14*b* slides on the surface of this developer conveyance plate 14*b* under a similar condition to the above-described first exemplary embodiment, and therefore a description of this condition will be omitted here to avoid redundancy.

In the present exemplary embodiment, the developer conveyance plate 14*b* is repeatedly vibrated by the cam member 15 and the biasing members 16*a* and 16*b*, which are used to construct the vibration providing member 13, in the following manner. The developer conveyance plate 14*b* is repeatedly vibrated in the developer conveyance direction J1 illustrated in FIG. 6B and the developer conveyance opposite direction J2 illustrated in FIG. 6C. As a result, the developer (the toner) on the surface of the developer conveyance plate 14*b* is conveyed in the developer conveyance direction J1 illustrated in FIG. 6B.

In the present exemplary embodiment, the force is applied to the vibration target unit 14*b*1, which protrudes under the lower surface of the developer conveyance plate 14*b*, by the rotation of the cam member 15 at a frequency of 20 Hz. Further, the displacement distance L1 of the distal end 14*b*2 of the developer conveyance plate 14*b* illustrated in FIG. 5, which corresponds to a difference between the position 14*b*2A of this distal end 14*b*2 illustrated in FIG. 6B and the initial position 14*b*2B of this distal end 14*b*2 illustrated in FIG. 6A, is set to approximately 1.5 mm.

Further, the displacement distance L2 of the distal end 14*b*2 of the developer conveyance plate 14*b* illustrated in FIG. 5, which corresponds to a difference between the position 14*b*2C of this distal end 14*b*2 illustrated in FIG. 6C and the initial position 14*b*2B of this distal end 14*b*2 illustrated in FIG. 6A, is set in the following manner. The displacement distance L2 is set in consideration of a weight of the developer (the toner) remaining in the developer storage unit 14*t*. Further, the displacement distance L2 is set in consideration of resistance received from the coupling member 14*d* and the biasing members 16*a* and 16*b* when the developer conveyance plate 14*b* is displaced in the developer conveyance opposite direction J2 illustrated in FIG. 6C. The displacement distance L2 is set to a smaller value than the displacement distance L1 illustrated in FIG. 6B according to these weight and resistance.

Further, the vibration target unit 14*b*3, which protrudes under the lower surface of the developer conveyance plate 14*b*, receives a biasing force of approximately 1.96 N (200 gf)/mm from the biasing members 16*a* and 16*b*. Further, the toner supported by the developer conveyance plate 14*b* is approximately 100 g in weight. Other features are configured similarly to any of the above-described exemplary embodiments, whereby the present exemplary embodiment can bring about similar effects.

Each of the above-described exemplary embodiments has been described as one example in which the vibration providing member 13, which is constructed with use of the piezoelectric element(s), is disposed on the main body side of the image forming apparatus 100. Also, each of the above-described exemplary embodiments has been described as one example in which the vibration providing member 13 constructed with use of the cam member 15 and the biasing members 16*a* and 16*b* is disposed on the main body side of the image forming apparatus 100. Besides this example, these vibration providing members 13 can be disposed on the process cartridge B side or the developer container 14 side.

Further, the vibration providing member 13 does not necessarily have to be limited to the piezoelectric elements, or the cam member 15 and the biasing members 16*a* and 16*b*, and may be constructed with use of any of various kinds of vibration means that can realize similar functions and effects.

Further, each of the above-described exemplary embodiments has been described as one example in the case where the developer conveyance plate 14*b* forming the bottom surface of the developer container 14 is substantially horizontally arranged when the process cartridge B is mounted on the main body of the image forming apparatus 100. Besides this example, the present invention can also be applied even in a case where the developer conveyance plate 14*b* forming the bottom surface of the developer container 14 is inclined at a predetermined angle with respect to the horizontal plane when the process cartridge B is mounted on the main body of the image forming apparatus 100.

According to an experiment conducted by the present inventors, an excellent result was able to be acquired even when the developer conveyance plate 14*b* described in the above-described second exemplary embodiment was set at the following inclination angle. Even when the developer conveyance plate 14*b* was arranged at a rising angle of 10 degrees with respect to the horizontal plane in the developer conveyance direction J1 illustrated in FIG. 5, the developer (the toner) on the surface of this developer conveyance plate 14*b* was able to be conveyed in the developer conveyance direction J1 illustrated in FIG. 5.

Further, each of the above-described exemplary embodiments has been described as one example in the case where the frame member 14*a* and the opening member 14*c* of the developer container 14 are prepared as different members from each other. Besides this example, the frame member 14*a* and the opening member 14*c* can also be configured integrally with each other. Further, the developing frame member 10*f*1 of the developing unit 10 and the opening member 14*c* can also be configured integrally with each other. Further, the developing frame member 10*f*1 of the developing unit 10, the opening member 14*c*, and the frame member 14*a* of the developer container 14 can also be configured integrally with one another.

Further, each of the above-described exemplary embodiments has been described as one example in the case where the frame member 14*a* and the coupling member 14*d* of the developer container 14 are prepared as different members from each other. Besides this example, the frame member 14*a* and the coupling member 14*d* of the developer container 14 can also be configured integrally with each other with use of a flexible member, such as polypropylene, polyethylene, nylon, an aluminum foil, a film, paper, and elastomer.

Further, the image forming apparatus 100 illustrated in FIG. 1 has been described as one example in which the image forming apparatus 100 is configured to allow the monochrome process cartridge B to be detachably mounted thereon and is configured to form a monochrome image. Besides this example, a plurality of developing units 10 (developing apparatuses), which serves as developing units for individual colors, can be provided. The image forming apparatus 100 can also be configured in the following manner. The process cartridges B that form an image with a plurality of colors (for example, a two-color image, a three-color image, a full-color image, or the like) are detachably mounted on the image forming apparatus 100. Then, the developer conveyance plate 14*b*, which forms the bottom surface of the developer container 14 of each of the process cartridges B, is vibrated with use of the vibration providing member 13 according to the above-described first or second exemplary embodiment, by which the developer (the toner) is conveyed.

Further, each of the above-described exemplary embodiments has been described as one example in the case where the unused developer (toner) stored in the developer storage unit 14*t* is conveyed. Besides this example, the present invention can also be applied to conveyance of the used toner (the residual toner after the transfer) collected in the removed toner storage unit 11*c* (in the cleaning unit), and conveyance of the toner at the developing unit 10 (the developing apparatus) or the like other than the process cartridge B.

Further, in each of the above-described exemplary embodiments, the vibration providing member 13 vibrates at a frequency of 5 Hz to 100 Hz. Further, regarding the inclination angle of the developer conveyance plate 14*b*, the developer (the toner) on the surface of the developer conveyance plate 14*b* can also be conveyed toward the opening 19 even in a case where the developer conveyance plate 14*b* is inclined at a rising angle smaller than 10 degrees with respect to the horizontal plane in the developer conveyance direction J1 illustrated in FIGS. 2 and 5.

Further, the developer (the toner) on the surface of the developer conveyance plate 14*b* can also be conveyed toward the opening 19 even in a case where the developer conveyance plate 14*b* is inclined at a descending angle of 60 degrees or smaller with respect to the horizontal plane in the developer conveyance direction J1 illustrated in FIGS. 2 and 5.

Further, in each of the above-described exemplary embodiments, the developer conveyance plate 14*b* is not made of an elastic member. However, the developer conveyance plate 14*b* can also be made of an elastic member capable of conveying the developer (the toner) and maintaining the substantially plate-like shape.

Further, in each of the above-described exemplary embodiments, the vibration providing member 13 constructed with use of the piezoelectric elements is disposed on the main body of the image forming apparatus 100. Alternatively, the vibration providing member 13 constructed with use of the cam member 15 and the biasing members 16*a* and 16*b* is disposed on the main body of the image forming apparatus 100. Besides this example, the vibration providing member 13 constructed with use of the piezoelectric elements, or the vibration providing member constructed with use of the cam member 15 and the biasing members 16*a* and 16*b* can be is disposed on the developer container 14.

In this case, the abutment portion 15*a* of the cam member 15 also periodically pushes the vibration target unit 14*b*1, which is disposed in the protruding manner below the developer conveyance plate 14*b* serving as the conveyance member, in the developer conveyance direction J1. The biasing members 16*a* and 16*b* exert the biasing force in the developer conveyance opposite direction J2, which is the opposite direction from the developer conveyance direction J1, when the abutment portion 15*a* of the cam member 15 is separated from the vibration target unit 14*b*1.

In this case, the developer container 14 should have an electric contact that receives the voltages or the like for driving the piezoelectric elements from the main body of the image forming apparatus 100. Alternatively, the developer container 14 should have an electric contact that receives the voltage or the like for driving the motor for rotating the cam member 15 from the main body of the image forming apparatus 100. Similarly, the main body of the image forming apparatus 100 should also have an electric contact for electrically connecting to the electric contact provided to the developer container 14.

According to the present invention, the dead space can be reduced in the path along which the developer is conveyed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-065550, filed Mar. 27, 2015, which is hereby incorporated by reference herein in its entirety.

What is claimed is:

1. A developer container configured to store developer therein, the developer container comprising:

a conveyance member configured to allow the developer to be placed thereon and convey the developer;

an opening member including an opening for discharging the developer; and a coupling member (i) coupling the opening member and the conveyance member with each other and (ii) capable of extending and compressing by receiving a vibration, wherein the conveyance member includes a vibration receiving portion configured to receive a vibration, and wherein the coupling member extends and compresses when the conveyance member conveys the developer toward the opening side by receiving the vibration through the vibration receiving portion, wherein the conveyance member forms a bottom of the developer container.

2. The developer container according to claim 1, wherein a storage unit where the developer is stored is formed by the conveyance member, the coupling member, the opening member, and a frame member.

3. The developer container according to claim 1, wherein the vibration receiving portion is located under the conveyance member.

4. The developer container according to claim 1, wherein the conveyance member is disposed on a lower end side where a lower end of the opening is located.

5. The storage container according to claim 1, wherein a maximum acceleration in a developer conveyance direction that is provided from the vibration receiving portion to the conveyance member is set to a lower acceleration than a maximum acceleration in an opposite direction from the developer conveyance direction that is provided from the vibration receiving portion to the conveyance member.

6. The developer container according to claim 1, further comprising a vibration providing member configured to vibrate the vibration receiving portion, wherein the vibration providing member includes a piezoelectric element.

7. The developer container according to claim 1, further comprising a vibration providing member configured to vibrate the vibration receiving portion, wherein the vibration providing member includes a cam member configured to periodically push the vibration receiving portion in the developer conveyance direction, and a biasing member configured to exert a biasing force in an opposite direction from the developer conveyance direction when the cam member is separated from the vibration receiving portion.

8. The developer container according to claim 1, wherein the coupling member is flexible.

9. A developing apparatus comprising:

a developer container configured to store developer therein, the developer container comprising:

a conveyance member configured to allow the developer to be placed thereon and convey the developer;

an opening member including an opening for discharging the developer; and a coupling member (i) coupling the opening member and the conveyance member with each other and (ii) capable of extending and compressing by receiving a vibration, wherein the conveyance member includes a vibration receiving portion configured to receive a vibration, and wherein the coupling member extends and compresses when the conveyance member conveys the developer toward the opening side by receiving the vibration through the vibration receiving portion, wherein the conveyance member forms a bottom of the developer container; and a developer bearing member configured to bear the developer conveyed by the conveyance member.

10. The developing apparatus according to claim 9, wherein the conveyance member, the coupling member, the opening, and the developer bearing member are arranged in this order from an upstream side to a downstream side in the developer conveyance direction.

11. A process cartridge comprising:

a developer container configured to store developer therein, the developer container comprising:

a conveyance member configured to allow the developer to be placed thereon and convey the developer;

an opening member including an opening for discharging the developer; and a coupling member (i) coupling the opening member and the conveyance member with each other and (ii) capable of extending and compressing by receiving a vibration, wherein the conveyance member includes a vibration receiving portion configured to receive a vibration, and wherein the coupling member extends and compresses when the conveyance member conveys the developer toward the opening side by receiving the vibration through the vibration receiving portion, wherein the conveyance member forms a bottom of the developer container.

12. An image forming apparatus comprising:

a developer container configured to store developer therein, the developer container comprising:

a conveyance member configured to allow the developer to be placed thereon and convey the developer;

an opening member including an opening for discharging the developer; and a coupling member (i) coupling the opening member and the conveyance member with each other and (ii) capable of extending and compressing by receiving a vibration, wherein the conveyance member includes a vibration receiving portion configured to receive a vibration, and wherein the coupling member extends and compresses when the conveyance member conveys the developer toward the opening side by receiving the vibration through the vibration receiving portion, wherein the conveyance member forms a bottom of the developer container; and wherein the image forming apparatus forms an image with use of the developer.

13. An image forming apparatus comprising:

a developer container configured to store developer therein, the developer container comprising:

a conveyance member configured to allow the developer to be placed thereon and convey the developer;

an opening member including an opening for discharging the developer; and a coupling member (i) coupling the opening member and the conveyance member with each other and (ii) capable of extending and compressing by receiving a vibration, wherein the conveyance member includes a vibration receiving portion configured to receive a vibration, and wherein the coupling member extends and compresses when the conveyance member conveys the developer toward the opening side by receiving the vibration through the vibration receiving portion, wherein the conveyance member forms a bottom of the developer container; and a vibration providing member configured to vibrate the vibration receiving portion, wherein the image forming apparatus forms an image with use of the developer.

14. The developer container according to claim 1, wherein the conveyance member is a plate.

* * * * *